United States Patent [19]

Rohde et al.

[11] 4,098,363

[45] Jul. 4, 1978

[54] DIAMOND DRILLING BIT FOR SOFT AND MEDIUM HARD FORMATIONS

[75] Inventors: Heino J. Rohde, Nienhagen; Rainer Juergens, Celle, both of Fed. Rep. of Germany

[73] Assignee: Christensen, Inc., Salt Lake City, Utah

[21] Appl. No.: 790,684

[22] Filed: Apr. 25, 1977

[51] Int. Cl.[2] ..... E21B 9/36

[52] U.S. Cl. ..... 175/329; 175/391; 175/400

[58] Field of Search ..... 175/329, 330, 391, 400, 175/418

[56] References Cited

U.S. PATENT DOCUMENTS

| | | | |
|---|---|---|---|
| 2,607,562 | 8/1952 | Phipps | 175/391 |
| 2,855,181 | 10/1958 | Olsen | 175/391 |
| 2,894,726 | 7/1959 | Weaver et al. | 175/391 |
| 3,135,341 | 6/1964 | Ritter | 175/391 |

*Primary Examiner*—James A. Leppink

*Attorney, Agent, or Firm*—Subkow & Kriegel

[57] ABSTRACT

The invention relates to bore hole drills employing spaced shaped cutters in arrays separated by fluid channels in which there are positioned arrays of nozzles suitable for bit cleaning and detritus removal action.

15 Claims, 12 Drawing Figures

DIAMOND DRILLING BIT FOR SOFT AND MEDIUM HARD FORMATIONS

BACKGROUND OF THE INVENTION

The invention relates to bore hole drills in which shaped cutters are included as preforms of bonded abrasive particles or as relatively large bodies of ceramics such as boron carbide, silicon carbide, titanium carbide and natural abrasives such as carbonados. The shaped cutters are of a size and shape of a different order of magnitude than diamonds, employed in prior art diamond drills. This difference creates a problem arising from the geometry of the drill and space consideration.

The problems of a suitable distribution of the shaped cutters in order that the cutters traverse the entire face of the bore hole which is being cut by the bit is aggravated by the requirements of the bit hydraulics.

As is well known in this art, the drilling fluid which is introduced through passageways in the bit is designed to cool the bit, wash the cutting elements so that they present a clean cutting face, move the cutting to the gage of the bit and lift them up the annulus between the drill string and the wall of the hole.

In order that the drilling fluid have this function, it must have a desirably high mass velocity through the drill bit nozzles without requiring an undesirable high back pressure.

These various requirements have been particularly difficult to meet where the bit is destined for operation in relatively soft formations where clogging of the bit is appreciable. It is also a problem in harder formations.

STATEMENT OF THE INVENTION

It is an object of our invention to employ discrete shaped cutters positioned at spaced locations across the face of the bit and to provide for bit hydraulics to insure cleaning of the cutters and to provide the required flushing and detritus lifting action. We accomplish this objective by the following expedients:

By employing shaped cutters such as preforms or carbonados, diamonds, and other shaped abrasive members in suitable arrays so that their paths on rotation of the bit cover substantially the entire surface to be cut.

By an arrangement of the nozzles so that the emitted fluid jets sweep across the array of cutters and on rotation cover the entire surface of the cut.

The shaped cutters are positioned on the face of the bit in spaced longitudinal arrays about the face of the bit from adjacent the center of the face to adjacent the gage of the bit with the cutting faces of the cutters in the same angular direction as the rotation of the bit. The cutters are arranged in each array in close relation so that on rotation of the bit the cutters traverse substantially the entire face of the bore hole end surface to be cut by the bit.

The longitudinal array of cutters are separated by junk slots which are also water courses. The junk slots separate the face of the bit into blades of wedge shape.

The drilling fluid is introduced through an axial bore of the bit and is discharged into fluid channels which may be but need not act as junk slots.

In our preferred embodiment, the discharge of drilling fluid passes through passageways which in our preferred embodiment terminate in nozzles which are positioned in the junk slots so that the fluid velocity along the slots is sufficient to cause a scouring of the cutters and is sufficient to carry the cuttings to the gage of the bit and up the annulus.

The nozzles are positioned in the junk slots in the face of the bit with their axis oriented and so distributed across the face of the bit that the ejected streams wash over the cutters and cover substantially the entire surface of the formation being cut by the bit when the bit is rotated.

These functions are accomplished in our preferred embodiment by positioning the nozzles in a spiral array so that they are in a plurality of substantially longitudinal arrays in each junk slot. In each junk slot the array is more closely positioned to the leading edge of the junk slot where the cutters are positioned than to the trailing edge of the next preceding blade portion. The several nozzles in our preferred embodiment are arranged in each longitudinal array so that the nozzle in each junk slot are spaced substantially equally from the leading edge of the junk slot where the cutters are positioned.

Our invention will be further described by reference to the following drawings which illustrate our preferred embodiment.

Figure 7:
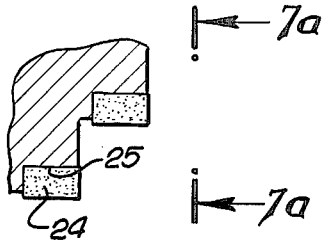
FIG. 7 is a fragmentary section showing the position of one form of cutter in the face of the bit.
Figure 7A:
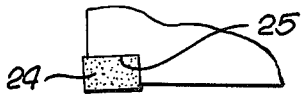

FIG. 7*a* is section taken on line 7*a*—7*a* of FIG. 7.

Figure 8:
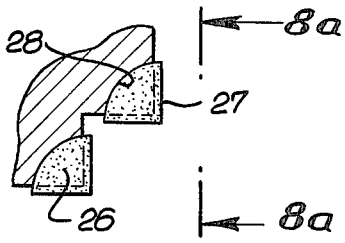
Figure 8A:
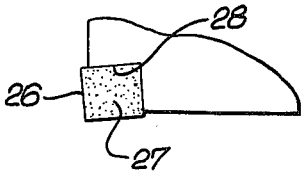

FIG. 8 is a view of another form of cutter positioned in the face of the bit; and FIG. 8*a* is a section taken on line 8*a*—8*a* of FIG. 8.

Figure 9:
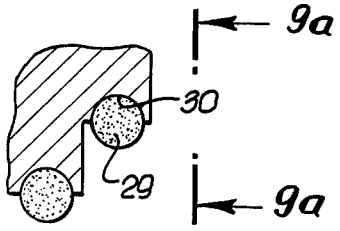

FIG. 9 is another form of cutter positioned in the face of the bit.

Figure 9A:
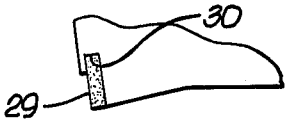

FIG. 9*a* is a section taken on line 9*a*—9*a* of FIG. 9.

The bit shown in the figures may be formed as described in the copending applications, Ser. No. 704,424 and Ser. No. 745,087 and the patents therein referred to, all assigned to the same assignee as the assignee of this application. We may employ the preforms and other cutter elements as described in said applications and patents. Said applications and patents are herein incorporated by this reference.

Instead of employing the spirally arranged stepped configuration as shown in the above applications, we may employ ridges and arrange them spirally as described in said applications or concentrically with suitable arrangement of cutters as described herein.

As described in said referenced applications and patents, the bit may be formed by the techniques usually employed in producing diamond bits whereby a hollow tubular steel mandrel, suitably formed, is coated in a carbon mold with metal bonded hard material such as tungsten carbide. The carbon mold is of a configuration such as to give a bit of the desired form. These procedures are well known to those skilled in the art.

Figure 1:
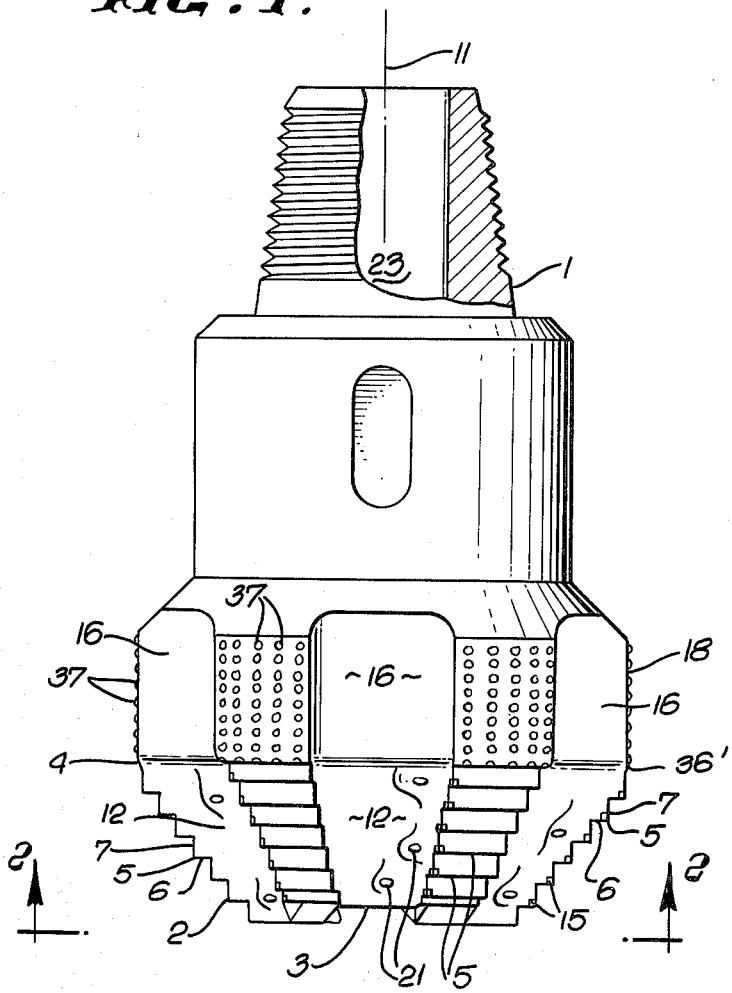
FIG. 1 shows a view of the bit according to our invention.
Figure 2:
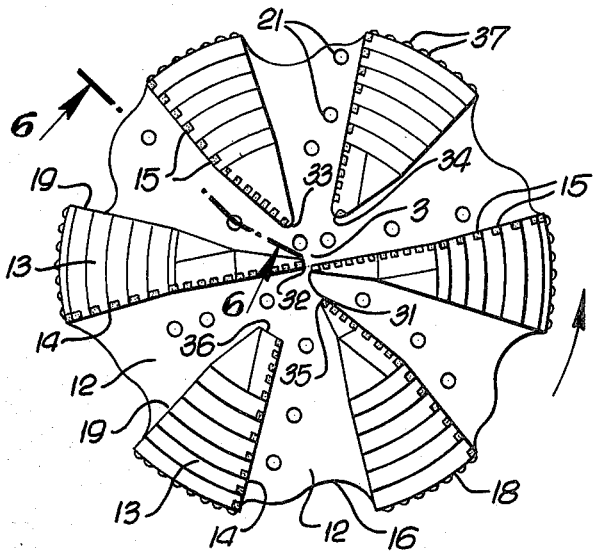
FIG. 2 is an end view of FIG. 1.

As shown in FIGS. 1 and 2, the face of the bit is formed on the closed end of a hollow steel mandrel 1. The face of the bit is formed with spaced ribs 2 which may extend either concentrically or spirally from adjacent the central portion of the bit 3 to adjacent the gage of the bit 4. In the forms of FIGS. 1 and 2, the ribs are in the form of steps 5 each composed of the land 6 and the rise 7. The central portion of the bit is formed (See FIG. 6) by an end surface 8 and a conical surface 9 with its apex at 10 at the central axis 11 of the bit. The end surface 8 is substantially flat and substantially perpendicular to the central axis 11 and connects to the stepped portion 5 and to a conical portion 9 at the center of the bit.

The face of the bit is interrupted by fluid channels 12 which also act as junk slots and which separate the face of the bit into blades 13. At the leading edge 14 of the blades cutters 15 are positioned in an arrays so that the cutters in one longitudinal array overlaps the cutters in the trailing blade so that the cutters will traverse the portion of the cut not covered by the cutters of a preceding leading blade, to assure that all portions of the surface to be cut are traversed by the cutters.

Figure 3:
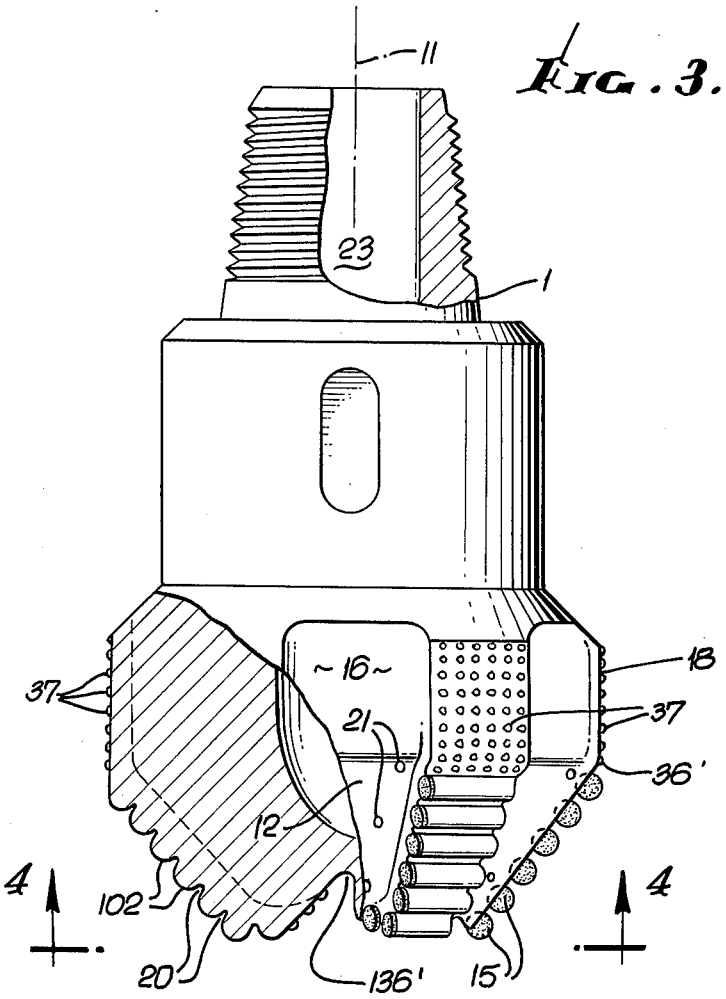
FIG. 3 is a plan view of another embodiment of our invention.

The junk slots in both the forms shown in FIGS. 1 and 3 extend from the center of the bit to the gage 4 of the bit. The junk slots at the gage connect with passageways 16 positioned in the stabilizer section 18 of the bit. Referring to FIGS. 1 and 2, the blades are formed with steps spaced from each other from a position at an area adjacent to the gage of the bit to the flat portion 8. The steps extend from the leading edge 14 of the blades to the trailing end 19 of the blades.

While the ribs may be arranged on concentric circles about the axis of the bit, we prefer to arrange them in a spiral formation starting adjacent the flat portion 8 of the bit to adjacent the gage of the bit as shown on FIGS. 1 and 2.

Figure 4:
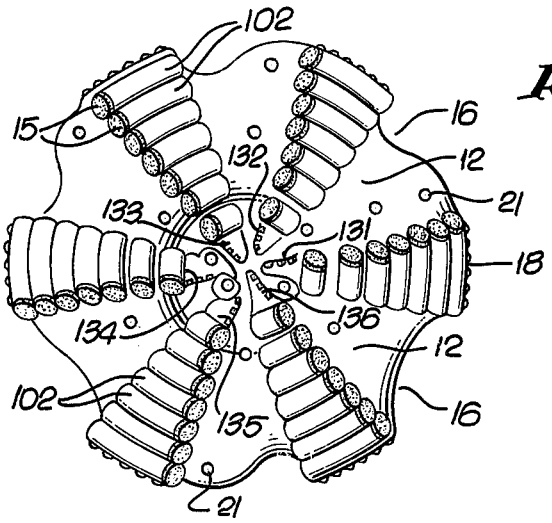
FIG. 4 is an end view of FIG. 3.

An alternative and preferred form of the bit of our invention is shown in FIGS. 3 and 4. This bit is formed as is described for the form shown in FIGS. 1 and 2.

The difference is in the form of the ribs and the shape of the face. Instead of lands and rises, the ribs are in the form of arcuate ribs 102 of cross section which may be semi-circular or segmental. The face of the bit extending from the rib is convex of an egg shaped form curving to a cuspidal central portion. The ribs extend from adjacent the gage to the central portion 136. All other parts are constructed similarly to those of FIGS. 1 and 2 and are similarly numbered.

The ribs, as in the case of steps of FIGS. 1 and 2, may be concentric circles or form a spiral which extends from adjacent the central portion of the face to adjacent the gage of the bit as shown on FIGS. 3 and 4.

The ribs are interrupted by junk slots which form wedge shaped blades similar to those shown in FIGS. 1 and 2 and which extend beyond the ribs into the central portion.

The ribs in the blades are spaced so as to form channels 20 which extend across the blades and interconnect the junk slots at the leading and trailing edges of the blades.

In the forms shown in FIGS. 1 and 4, the shaped cutters are mounted in the leading end of the ribs of the blades in sockets provided in the face of the bit at the appropriate location as described below.

The cutter elements to be more fully described below are positioned in sockets formed in the face of the bit at the leading edge of the blades. They are positioned in the leading edges of the ribs of the blades in longitudinal arrays. They are also held in like manner in equally spaced array in the flat portion 8 and the conical portion 9 of FIGS. 1 and 2. As stated previously, the spacing of the cutters in each of the longitudinal arrays is such that they traverse the entire surface of the cut when the bit is rotated. The cutters are each of suitable shape and size to accomplish this purpose as will be more fully described below.

The hydraulics, that is the distribution of the drilling fluid across the face of the bit, is provided by suitably arranged nozzles 21 positioned in passageways 22 in the face of the bit which passageways commence at the central bore 23 of the bit and terminate at the junk slots.

Figure 6:
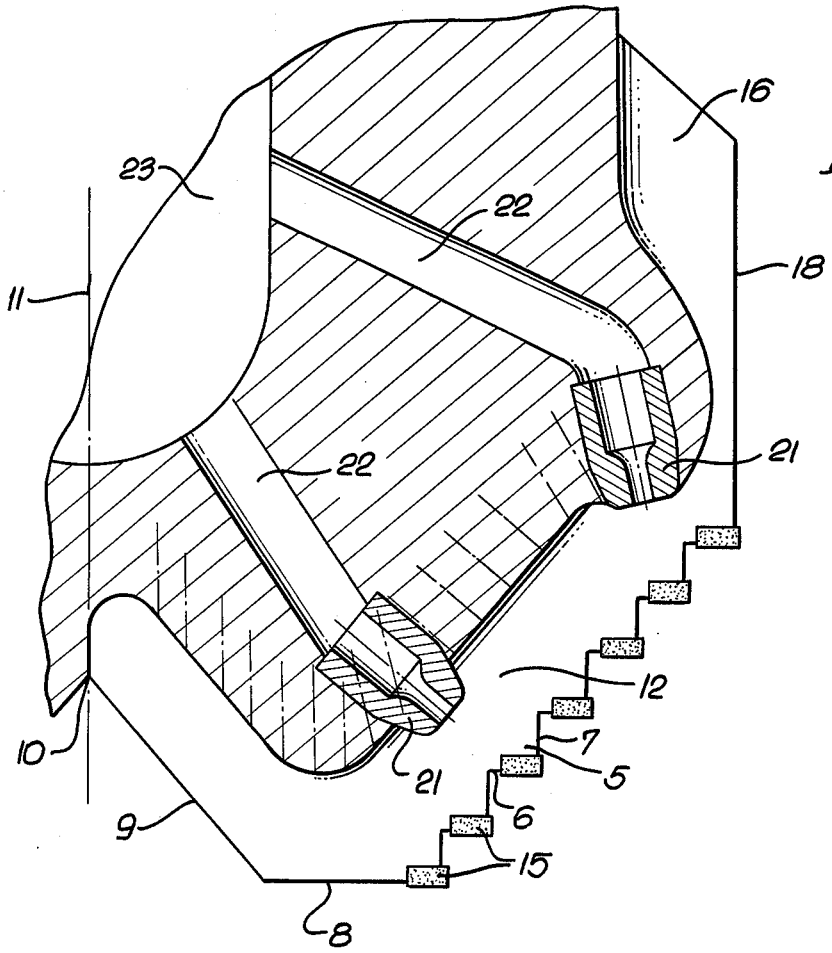
FIG. 6 is an enlarged and fragmentary sectional view on line 6—6 of FIG. 1.

The individual nozzles, see FIG. 6, are positioned, in the form of FIGS. 1 and 3, in each junk slot in a longitudinal array but not necessarily a linear array with the nozzles in the array spaced more closely to the leading edge of the blades where the cutters are positioned than they are to the trailing edge of the next leading blade.

Due the wedge shape of the blade which provides that the edges of the blade are not radially positioned, and the conical shape of the envelope of the face, see FIG. 2 or the egg-shaped form of the face of FIG. 4, the nozzles in each longitudinal array may be displaced from a linear array in order to provide for substantially equal distances between the axis of each of the nozzles and the adjacing leading edge of the adjacent blade in each nozzle array.

Figure 5:
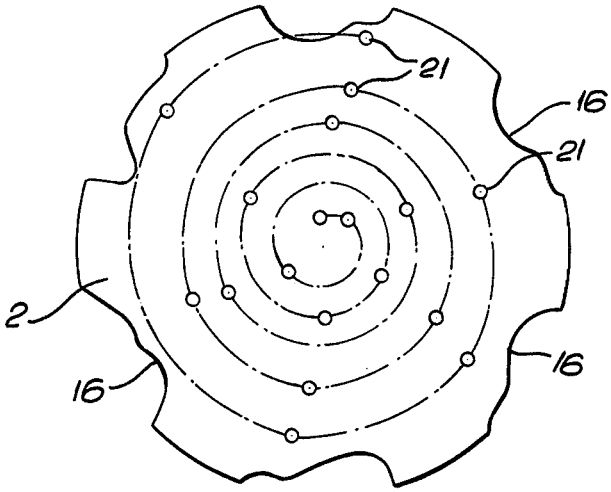
FIG. 5 is a schematic view of the arrangement of the nozzles.

The nozzles are arranged in our preferred embodiment in longitudinal arrays which are separated from each other at substantially equi-angular distances. A preferred embodiment is, as illustrated in FIG. 5 where the longitudinal arrays of nozzle are as shown separated by approximately 60° and the nozzles are positioned in longitudinal arrays extending from adjacent the center to adjacent the gage of the bit. The several nozzles are positioned in a spiral arrangement extending from adjacent the center of the bit to the gage of the bit as appears from FIG. 5.

In the forms of FIGS. 1 and 3, the separation of the ribs from each other in each blade forms a communication between the adjacent junk slot across the blades. The force of the fluid ejected from the nozzles and the rotation of the bit will cause fluid to wash across the face of the blades between the ribs and over the ribs to remove detritus which forms between the ribs.

The purpose of this arrangement as described above is to cause the several streams ejected through the nozzles in each array to wash over the cutters in the adjacent cutter array and to impinge on and cover substantially the entire surface of the area to be cut on rotation of the bit. The arrangement also provides space in the junk slots for a returning stream of drilling fluid carrying the cuttings. Room is thus provided for the return stream along the junk slot in the face of the bit and up the water passages 16 in the stabilizer.

The cutters referred to above may be natural diamonds including black diamonds known as carbonados.

Instead, we may use shaped ceramic bodies such as boron nitride, silicon carbide, tungsten carbide or alumina.

We prefer, however, to employ a preform cutter formed under high pressure and temperatures shown as Compax sold by General Electric Company. It is a shaped cutter of diamonds bonded by a suitable matrix material. It is understood that this preform is manufactured by a process described in U.S. Pat. No. 3,745,623.

The cutters which may be employed in our invention may be of various designs. Several are illustrated in FIGS. 7, 8 and 9.

In FIGS. 7, and 7*a*, the cutter is a parallelepiped 24 of lengths so that they will extend substantially the width of the lands and along substantially the entire surface of the flat and conical section, in suitably spaced sockets 25 formed in the face of the bit as shown in FIGS. 1 and 2.

In FIGS. 8 and 8*a*, the cutter 26 is a quarter sector of a right cylinder with the central external face 27 at the radius and a peripheral arc 27 sitting in suitably formed sockets 28 in the face of the bit at the rise in each step.

An alternative and preferred form of cutter is the cylindrical cutter 29 shown in FIGS. 9 and 9*a*. The diameter of the cylinder is substantially greater than the height of the cylinder. The cylindrical cutter fits into a socket 30 formed in the face of the bit at the leading edge of the ribs.

In each of the forms of cutters, the cutting faces are all oriented in the same angular direction in the direction of rotation of the bit and extend from the surface of the face of the bit as is illustrated in FIGS. 7, 8, and 9. In the form of FIGS. 1 and 2, the cutters in the conical and flat portion may be in the shape of the cutters as above and are of length and are spaced from each other so that on rotation of the bit the entire surface of the cut is traversed by the cutters.

We prefer to mount the cutters in sockets so that the thrust imposed by the cutting action upon the cutter is transmitted to the body of the bit. As shown in FIGS. 3, 4, 9 and 9*a*, we prefer to mount the cutters in sockets so that about less than half, and preferably about 20–40%, e.g. 30% of the exterior surface of the cutter is exposed and the cutter is backed by the body of the bit.

We also prefer to mount the cutter so that they have a backward rake for example, 15° as is illustrated in FIGS. 7, 8 and 9.

The use of shaped discrete cutting elements such as employed herein presents problems in assuring the presence of cutting elements at the center and at the gage of the bit. In the forms of FIGS. 1 and 2, the presence of the cutting elements at the center is provided by arranging the blades so that they extend to various radial distances from the center of the bit. (See FIGS. 2 and 4) The terminal ends of the ribs of FIG. 2 and the terminal ends of the ribs of FIG. 4 are arranged in a staggered formation to assure the presence of cutting elements to cover the entire surface of the cut. A reference to FIG. 2, the spiral arrangement will be seen by reference to terminal ends 31 which crosses the center and spirally, 32, 33, 34, 35 and 36 and in FIG. 4 the terminal ends 131, 132, 133, 134, 135, and 136.

The provision of cutters in the blades extending to the terminal ends of the blades will insure that the entire surface, including the central surface is traversed by cutters. If desired, the area at the center and between the terminal ends of the cutters of FIG. 2 may be supplemented by including diamonds at the central portion. These may be positioned during the casting of the bit in the conventional manner.

In the form of FIGS. 3 and 4 since the central portion of the bit is not covered by preforms, the bit would, unless additional cutters are provided, leave an uncut portion at the center. To avoid such a result, we position in the return portion of the blades a number of diamonds, carbonados or preforms in the face of the bit at the central portion. They are illustrated by the carbonados shown in FIGS. 3 and 4 at 135.

In both of the forms of FIGS. 1 and 3, the spacing of the ribs will provide an area adjacent the gage where cutters will not be placed. In both the forms of FIGS. 1 and 3, diamonds 37 or other suitable abrasive elements may be positioned at and adjacent the gage to supplement and complete the cutting action of the bit. These may be inserted by the conventional manner.

Additionally, as is conventional, in this art, the stabilizer section may be hard faced as for example, by diamond particles distributed along the face of the stabilizer as shown in 37. The above configuration of the bit will provide that the entire surface of the cut will be traversed by cutting elements and that the drilling fluid passing through from the nozzles will wash at high velocity over the cutters and cover the entire surface of the cut returning the detritus along the junk slots to the passageways in the stabilizer to be returned to the annulus.

I claim:

1. A bit comprising a central bore and a face formed about said bore, fluid channels extending from adjacent the center of the bit to the gage of said bit and separating said face into wedge shaped blades, cutting elements positioned in the leading edge of said blades and a plurality of passageways positioned in said face and each passageway connecting to said bore and opening into each of said fluid channels in a longitudinal array in each of said fluid channels and positioned adjacent the leading edge of said blades, said openings being arranged in a spiral array extending from adjacent the central portion of the face to adjacent the gage of the bit.

2. In the bit of claim 1, said cutting elements being shaped cutting elements and positioned in said face at leading end of said ribs with a portion of the cutting face of the cutting element exposed and the remainder of said cutting element mounted in said face.

3. In the bit of claim 2, additional cutting elements positioned in the central portion of the bit and adjacent the gage of the bit.

4. In the bit of claim 2, each of the cutters positioned in slots formed in the face of the bit at the leading end of said ribs.

5. In the bit of claim 4, additional cutting elements positioned in the central portion of the bit and adjacent the gage of the bit.

6. A bit comprising a central bore and a face formed about said bore, fluid channels extending from adjacent the center of the bit to the gage of said bit and separating said face into wedge shaped blades, cutting elements positioned in the leading edge of said blades and a plurality of passageways positioned in said face and each passageway connecting to said bore and opening into each of said fluid channels in a longitudinal array in each of said fluid channels and positioned adjacent the leading edge of said blades, spaced ribs positioned in said blades extending across said blades said cutting elements positioned at the leading edge of said ribs adjacent said fluid channels, said passageways extending to and opening in each fluid channel adjacent said cutting elements and at substantially equally spaced distances from said cutting elements.

7. In the bit of claim 3, said cutting elements being shaped cutting elements and positioned in said face at leading end of said ribs with a portion of the cutting face of the cutting element exposed and the remainder of said cutting element mounted in said face.

8. In the bit of claim 7, additional cutting elements positioned in the central portion of the bit and adjacent the gage of the bit.

9. In the bit of claim 7, each of the cutters positioned in slots formed in the face of the bit at the leading end of said ribs.

10. In the bit of claim 9, additional cutting elements positioned in the central portion of the bit and adjacent the gage of the bit.

11. A bit comprising a central bore and a face formed about said bore, fluid channels extending from adjacent the center of the bit to the gage of said bit and separating said face into wedge shaped blades, cutting elements positioned in the leading edge of said blades and a plurality of passageways positioned in said face and each passageway connecting to said bore and opening into each of said fluid channels in a longitudinal array in each of said fluid channels and positioned adjacent the leading edge of said blades, spaced ribs positioned in said blades extending across said blades said cutting elements positioned at the leading edge of said ribs adjacent said fluid channels, said passageways extending to and opening in each fluid channel adjacent said cutting elements, said openings being arranged in a spiral array extending from adjacent the central portion of the face to adjacent the gage of said bit.

12. In the bit of claim 11, said cutting elements being shaped cutting elements and positioned with the cutting face at leading end of said ribs with a portion of the cutting element exposed and a portion of said cutting element mounted in said face.

13. In the bit of claim 12, additional cutting elements positioned in the central portion of the bit and adjacent the gage of the bit.

14. In the bit of claim 12, each of the cutters positioned in slots formed in the face of the bit at the leading end of said ribs.

15. In the bit of claim 12, additional cutting elements positioned in the central portion of the bit and adjacent the gage of the bit.

* * * * *

UNITED STATES PATENT AND TRADEMARK OFFICE

CERTIFICATE OF CORRECTION

PATENT NO. : 4,098,363

DATED : July 4, 1978

INVENTOR(S) : Heino J. Rhode et al.

It is certified that error appears in the above—identified patent and that said Letters Patent is hereby corrected as shown below:

Claim 2, line 3, change "ribs" to -- blades --.

Claim 4, line 3, change "ribs" to -- blades --.

Claim 7, line 3, change "ribs" to -- blandes --.

Claim 9, line 3, change "ribs" to -- blades --.

Signed and Sealed this

*Twenty-ninth* Day of *January 1980*

[SEAL]

*Attest:*

SIDNEY A. DIAMOND

*Attesting Officer*

*Commissioner of Patents and Trademarks*